ADJUSTABLE ROTARY CRUSHER

BACKGROUND OF THE INVENTION

This invention relates to rotary crushers for pulverizing solid materials, and to a method and system for classifying the pulverized product. In particular, it relates to a rotary crusher having the capability with very little adjustment to provide relatively uniform product particle sizes ranging from rather large chunks to very fine powders. The invention also features a collection system for finely ground material which permits the crusher exhaust to assist in the recovery and classification of finely ground material.

Commercial crushers are required to perform a wide variety of crushing chores. For example, it may be desired to reduce the size of ordinary rock from 6"+ to $-\frac{3}{4}$" for use as paving aggregate. Alternatively, to prepare mineral-containing ore for chemical processing it may be desired to crush chunks of ore to a product size of approximately 30 mesh. In other instances, such as the pulverizing of coal for use in utility boilers, or cement manufacture, product particle sizes of 100 to 200 mesh may be required. At the present time, no single available crusher can satisfy the wide variety of product distributions and product sizes which may be desired without extensive modification. Accordingly, there is a substantial demand for a crusher which is sufficiently flexible to provide utility for a large number of feed materials and product size and distribution.

Rotary crushers of the general type disclosed herein have been described in my existing U.S. Pat. Nos. 3,887,141; 4,037,796; and 4,077,574. These patents disclose a crusher having an impact rotor positioned within a reduction chamber and having a plurality of hammerheads around its periphery. Ore entering the reduction chamber is directed tangentially against the hammers and hurled against the sides of the reduction chamber. The internal walls of the reduction chamber are lined with shatterbars which assist in reduction of the ore to a finer particle size. As particles fall to the bottom of the chamber, they are swept back into the downstream side of the reduction chamber by a rapidly moving fluidizing rotor located beneath the impact rotor. Air enters the reduction chamber through inlets in its side, and crushed particles are swept upwardly through a vertical classification chamber to permit removal of particles within certain size ranges. As shown in U.S. Pat. No. 4,037,796, particle diverter plates and air deflector flaps are used within the classification chambers to direct particles of various sizes into their proper classification.

With the prior art devices, particle size distribution is relatively fixed by the crusher design. While some flexibility exists to produce a very finely pulverized product by adjusting rotor speed, air flow, and classification chamber height, these mills can handle only a relatively narrow variety of feeds and product size distribution requirements. It has been found that with relatively minor modifications, the crusher described in U.S. Pat. No. 4,037,796 can be designed to do the work of three separate crushers; i.e., having product particle sizes corresponding to ranges generally referred to as secondary, tertiary, and fine grinding. In addition, it has been discovered that energy generated by the rotating hammers can be used to classify finely ground materials into a plurality of desired product distributions.

The crusher and classification system of the invention are characterized by the crusher having three separate and independent product takeoff points, including 2 exits used for very light crushing operations (i.e., where the product particle size is relatively large). In addition, the crusher is characterized by an offset unimpeded vertical attrition chamber, containing no deflectors or product removal means, where the attrition of rising small particles with falling larger particles creates further particle comminution. In addition, product classification from the exhaust from the crusher is effected through the use of the energy contained in the air/particle stream to assist in classifying the product. This classification may be accomplished by thrusting the product stream into a centrifugal separator, such as a cyclone collector, wherein the larger particles exit the bottom of the unit and smaller particles are carried across the top thereof. Alternatively, the product exit stream may be directed horizontally across a series of bins, with the larger particles falling by gravity into the bins nearest the exit, and smaller particle sizes falling at a greater distance from the exit.

BRIEF SUMMARY OF THE INVENTION

In a system for crushing solid particles having a housing, a particle inlet chute, an impact reduction chamber within the housing, an impact rotor having impact hammers at its periphery, a drive motor to turn the impact rotor at high velocity, a motor driven fluidizing rotor removably mounted near the bottom of the impact reduction chamber, the improvement therein which comprises an unobstructed attrition chamber having, at a lower section thereof, a vertically decreasing cross-sectional area, said attrition chamber extending vertically above the impact rotor, first product exit means located at the bottom of the impact reduction chamber, second product exit means located in a side of the housing opposite the inlet chute, and third product exit means at the upper end of the attrition chamber. In another embodiment of the invention, a particle crushing/classifying system comprises a crusher housing, a particle inlet chute, an impact reduction chamber containing a motor driven impact rotor, a fluidizing rotor, an unobstructed vertical attrition chamber having at least along a portion thereof a vertically decreasing cross-sectional area, product exit means in communication with the attrition chamber oriented to thrust an air/particle product stream in a substantially horizontal plane, and a plurality of crushed particle collection bins located at various distances from the exit to permit classification of particles by gravity flow into the various bins.

BRIEF DESCRIPTION OF THE DRAWINGS

The invention is best understood with reference to the drawings in which.

ELECTROMAGNETIC MILLING DEVICE

FIELD OF THE INVENTION

Figure 1:
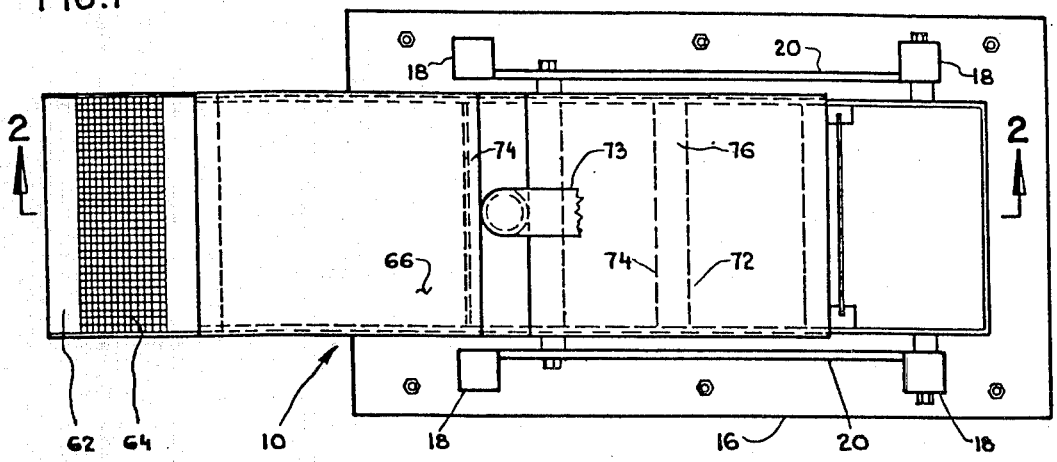
FIG. 1 is a perspective exterior view of the feed system, rotary crusher, multiple bin classification system, and dust collector (i.e., fine grinding mode)

The invention relates to a device for crushing, pulverizing, classifying, dedusting and dewatering ores, or other materials.

DESCRIPTION OF THE PRIOR ART

Conventional ore crushing apparatus usually employs massive crushing jaws, one being fixed and the other vibrated. Complex and heavy equipment is required to generate the requisite vibration. One example is disclosed in the Bodine, Jr. U.S. Pat. No. 3,131,878 which utilizes sonic wave action. Another example is disclosed in U.S. Pat. No. 2,656,120 issued to Roubal wherein gyratory action is used to vibrate one jaw within the other. In the Herzog U.S. Pat. No. 3,840,191, a vibrating plate mill is supported on springs and vibrated by an electric motor and eccentric weight suspended from the plate. The Bodine patent, U.S. Pat. No. 3,682,397 suggests improving sonic vibrating devices by feeding the ore along a trough covered by a rubber blanket or through a liquid mercury bath to retain the ore accoustically coupled to the feeding surface.

SUMMARY OF THE INVENTION

It is a primary object of the present invention to provide an ore crushing mill which is small and compact and thus overcomes the defects and disadvantages of conventional mills as briefly outlined above.

It is another important object of the invention to provide in one small unitary device, a mill which continuously operates to crush, pulverize, classify, dedust and dewater the ores.

It is still another important object of the invention to provide an improved mill, having the above described characteristics, in which the mill utilizes a trough seating crusher and pulverizer bars vibrated by electromagnetic force generated by a pulse generator.

Still, further objects of the inventions are to provide a mill, having the above-described characteristics, which is of simple construction, easy to fabricate and operate, inexpensive to make and use, and which is free from environmental or other hazards, whereby improved safety is achieved as compared to conventional mills.

BRIEF DESCRIPTION OF THE DRAWINGS

Figure 2:
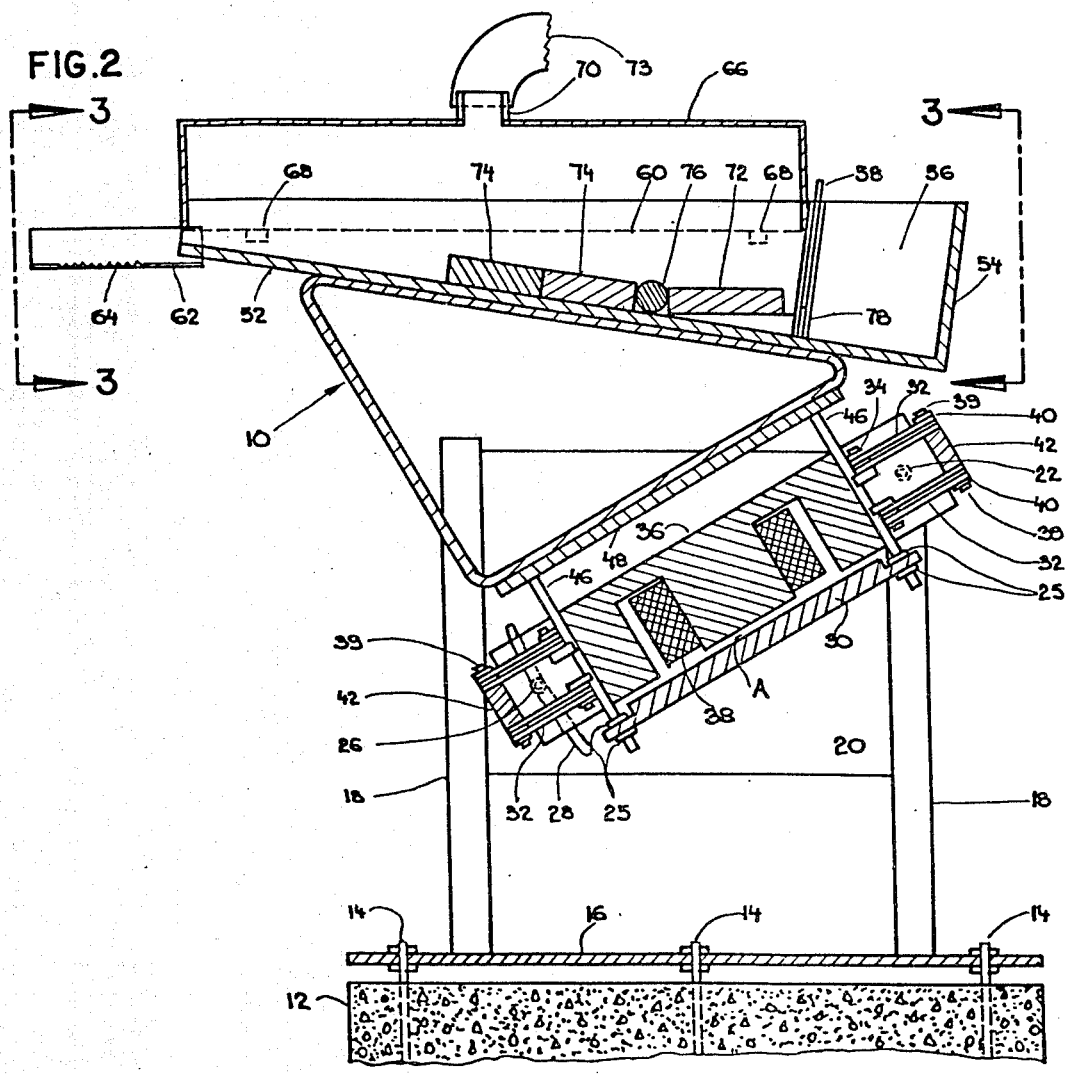
FIG. 2 is a side cross-sectional view of the crusher and bin collection system.
Figure 3:
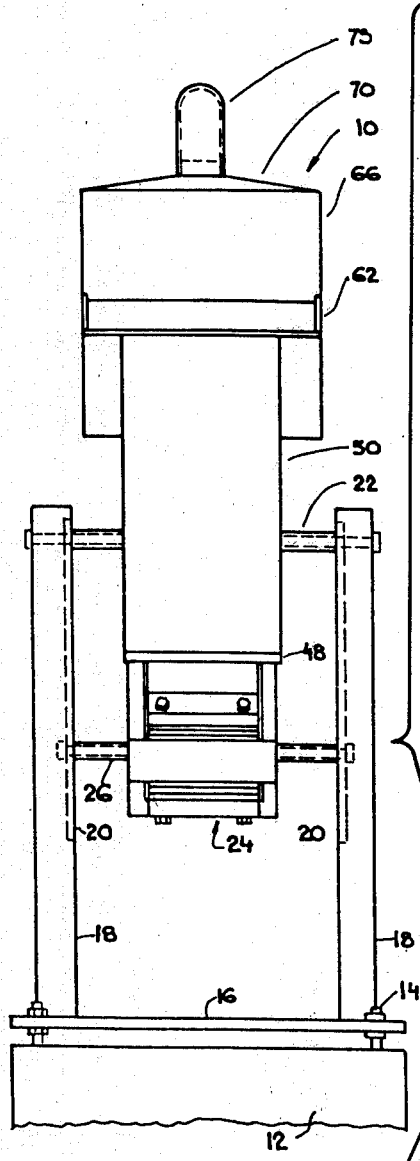
FIG. 3 is a side elevational cross-section view of the crusher in secondary crushing mode.
Figure 4:
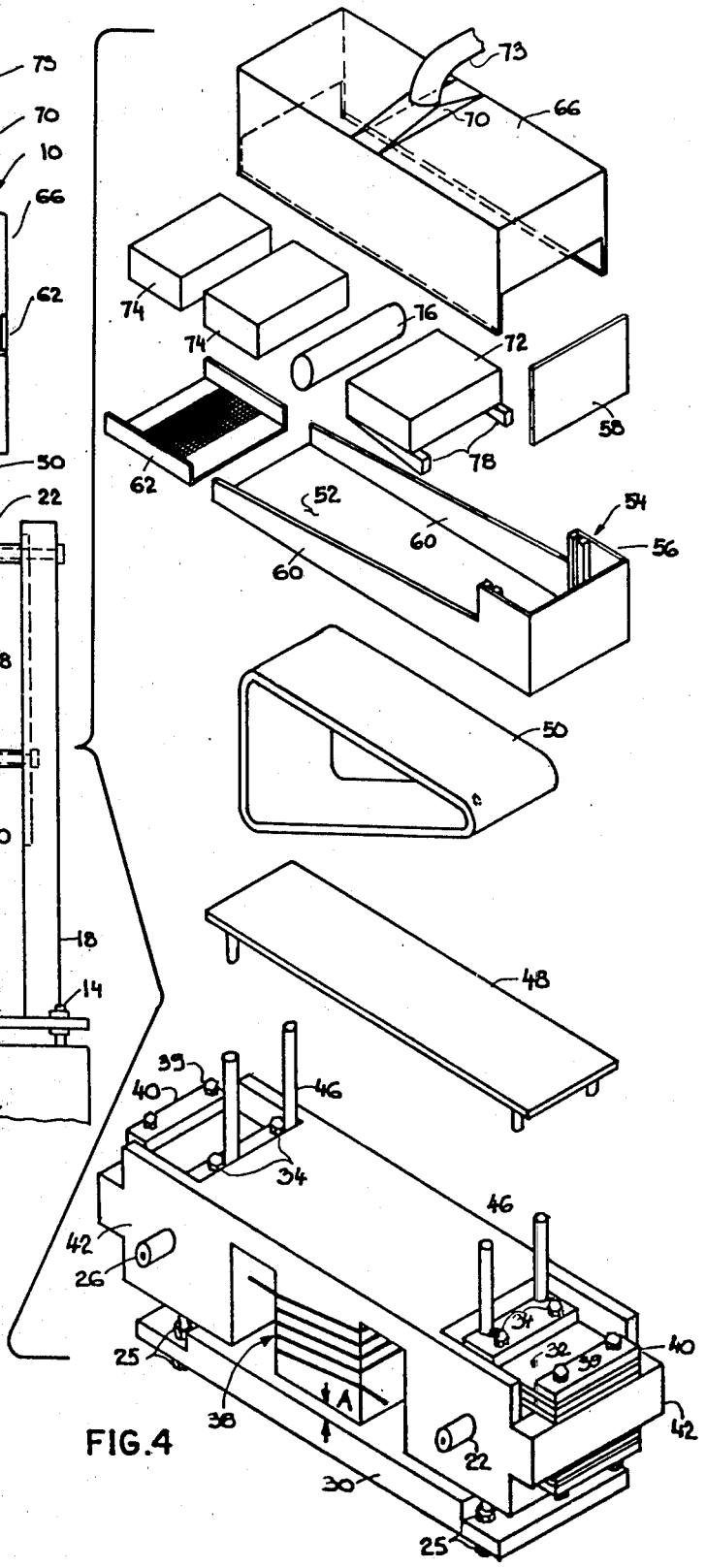
FIG. 4 is a side elevational cross-sectional view of the crusher in tertiary crushing mode.

The novel features that are considered characteristic of the invention are set forth with particularity in the appended claims. The invention itself, however, both as to its organization and its method of operation, together with additional objects and advantages thereof, will be best understood from the following description of a specific embodiment, when read in connection with the accompanying drawings, wherein like reference characters indicate like parts throughout the several figures, and in which:

FIG. 1 is a top plan view of the major portion of a mill according to the invention;

FIG. 2 is a sectional view taken along line 2—2 of FIG. 1 and looking in the direction of the arrows;

FIG. 3 is an end elevational view taken from line 3—3 of FIG. 2;

FIG. 4 is an exploded perspective view of the mill; and

Figure 5:
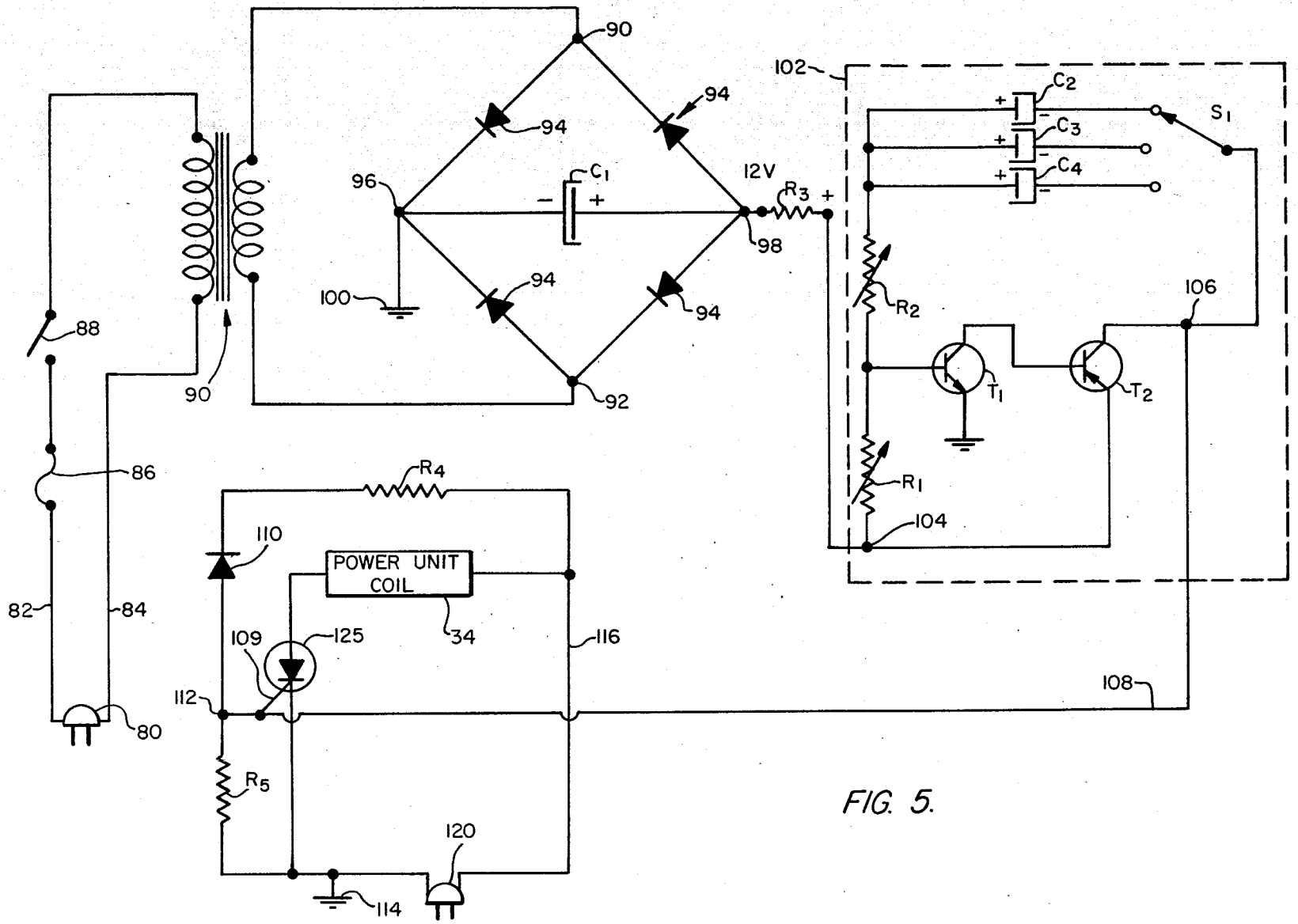
FIG. 5 is a schematic diagram of a fine-grind collection system using the centrifugal separators.

FIG. 5 is a schematic diagram of the electric circuit for energizing the mill.

DESCRIPTION OF THE PREFERRED EMBODIMENT

Referring now more specifically to the drawings, the mill 10, according to the invention, comprises a strong concrete base 12 in which are embedded bolts 14 supporting a horizontal metal base plate 16. Firmly secured to plate 16, as by welding, are four metal posts 18 defining the corners of an upstanding rectangle, having one pair only of opposed side walls 20,20. At the tops of the two right hand posts 18, as viewed in FIG. 2, is carried a pivot bolt 12 traversing the space between these posts and intended for adjustably supporting the electromagnetic power drive unit 24, to be described. The opposite end of drive unit 24 is adjustably supported by bolt 26 which traverses the space between side walls 20,20 and which may be movably fixed anywhere along a pair of arcuate slots 28,28 machined in the walls 20.

The power drive unit 24 comprises a rectangular drive plate spaced by air gap A from the electromagnet core 36 made of laminated silica steel sheets, a highly magnetic material. The U-shaped metal ends 42 are welded to the ends of the core 36. The electromagnet coil 38 is formed around the central portion of core 36. Upper and lower stacks of fiber glass leaf springs 32 are secured to the end members 42 by stud bolts 39 passing through holes in bars 40 and springs 32 and screwed into the bases of the U-shaped end members 42. The other ends of springs 32 are bolted at 34 to bars 44 which are each welded to a pair of upstanding power drive rods 46. The rods 46 are fixed at their bottoms to drive plate 30 as by threads and nuts 25, and at their upper ends to a rectangular plate 48 parallel to drive plate 30, as by welding. The air space A between the core and the drive plate is adjusted to maximum power by threaded movements of upper and lower nuts 25.

Energization of coil 38 lifts plate 30 and attached rods 46 and plate 48. The spring action of the leaf springs 32 returns the drive plate 30 to its unmagnetized position after the coil has been deenergized.

Seated on the transfer plate 48 and firmly affixed thereto, as by welding, is one side of a triangular, trough angle positioner 50, formed of a metal band having substantially the same width as transfer plate 48 and formed into a right-angled, isosceles triangle whose hypotenuse is fixed to the heavy metal bottom wall 52 of trough 54.

The trough 54 has an ore feed hopper 56 at its inlet end, the feed being controlled by a vertically movable gate 58. The side walls 60,60 of the trough taper somewhat in the direction of the outlet end of the trough, at which end is affixed an outlet chute 62 with a screen portion 64 in its bottom. A hood 66 is affixed to the trough 54, or suitably otherwise suspended to cover the trough, positioning lugs 68 being provided on its depending side walls to properly position the hood with respect to the upper edges of trough walls 60. Centrally of the hood top wall is an unstanding vent 70 to which is attached a duct 73 leading to a suction source, not shown.

Seated on trough bottom 52 and resting there solely by gravity is a heavy crusher bar 72 and a pair of pulverizer bars 74,74, the latter being spaced from the former by a cylindrical bar 76. The bottom edge of crusher 72 closest to the inlet end of trough 54 is somewhat elevated by a pair of wedge shaped feet 78,78.

This allows entrance of ores under the crusher 72 and between its bottom surface and the bottom wall of the trough.

The power drive unit is energized by the circuit shown in FIG. 5. The plug 80, which may be connected to a suitable AC source, such as 120 volts, is connected by leads 82 and 84 to a fuse 86, on-off switch 88 and the primary of transformer 90, all in series. The transformer secondary is connected across terminals 90,92 of a full-wave rectifier having a diode 94 in each of its branches. A capacitor C1 is connected between terminals 96,98, terminal 96 being grounded at 100 and terminal 98, supplying low voltage DC (12 v) to the sine wave generator 102 through resistor R3. The sine wave generator has an input terminal 104 and an output terminal 106. The input terminal is connected through variable resistor R1 to the base of NPN transistor T1 whose emitter is grounded and whose collector is connected to the base of PNP transistor T2. The collector T2 is connected to output terminal 106, while its emitter is connected to the input terminal 104.

Across terminals 104,106 are a plurality of parallel branches each containing the series connection of variable resistors R1 and R2, switch S1 and one of the capacitors C2, C3 or C4. These capacitors each have a predetermined value, as for example 30 MFD, 10 MFD and 2 MFD, respectively, depending on the desired pulse frequency. The capacitor selected by switch S1 will be discharged periodically, as current flows from the negative side of the capacitor to terminal 106, at a rate dependent upon the value of the capacitor and the selected values of R1 and R2. R2 controls the sine wave frequency, while R1 controls the pulse duration. In this manner, DC pulses are delivered from the output terminal 106 along lead 108 to the gate 109 of the silicon controlled rectifier 125 (SCR), at a frequency which can be selected within the preferred range of 5 to 60 pulses per second, corresponding to the discharge frequency of capacitors C2, C3 and C4.

SCR 125 is connected between power unit coil 34 and power source 120, which may be either AC or DC. By using diode 110 and resistor R4, a bucking current is obtained which cancels the flow of current in the opposite direction during the negative half cycle. R5 is a gate biasing resistor for the SCR. Thus, the sine wave generated along line 108 cause the SCR 125 to gate the power source 120 to the power unit coil 38 in pulses of controlled frequency and duration.

In operation, the operator selects capacitor C2, C3 or C4 via switch S1, depending upon the pulse rate desired for the ore to be crushed, and then closes switch 88 to generate the pulses. For example, in crushing a heavier rock, a lower frequency, longer duration pulse train might be employed, while for lighter rock, a shorter duration higher frequency pulse train would be generated. Each pulse sends a strong surge of DC current through coil 38 of the power drive unit 24. As previously explained, with each pulse the coil 38 attracts plate 30 toward core 36 closing the power unit air gap A, and also lifts the attached rods 46, plate 48, angle positioner 50, and trough bottom 52. Thus, for each pulse a lifting force is exerted on the crusher and pulverizer bars 72,74 and spacer 76, lifting them off the trough bottom to which they drop back by gravity at the end of each pulse. Ore particles containing magnetic metal entering the trough are also lifted and dropped. The ore entering the trough through hopper 56 moves to the left under crusher 72 and the impact of the ore between the bottom of the crusher bar 72 and the trough wall 52 reduces the ore in size.

As the size of the ore is reduced, it escapes and travels leftward as viewed in FIG. 2, passing successively under the vibrating spacer 76 and pulverizers 74,74 where it is further reduced to the required mill size. The size is controlled by the angle of the trough. The steeper the angle, the finer the grind. This angle is of course, preselected by the adjustment of bolt 26 in slots 28. As the fines travel up and to the left in the trough, the dust is contained in hood 66 from which it is vacuum sucked through duct 70. The fines continue to travel leftward, passing along and over the end of outlet chute 62 into a container, not shown. In case of a wet grind, the fines and water pass into chute 62, the water dropping through screen 64 into a separate tank, not shown.

It will be apparent, from the above, that the mill permits an ore feed to be pulverized in a fully automated process which includes crushing, pulverizing, classifying, dedusting and dewatering. The tonnage is limited only by the size of the mill and the time of operation. The feed size of the ore is selected and determined by the size of the entry spacing under the crusher bar 72. The angles of positioner 50 and the lengths of slots 28 may be varied to change the slope of the trough 54, and the slots 28 permit adjustment between upward and downward slopes through a range of plus or minus 15° with respect to the horizontal.

While a certain preferred embodiment of the invention has been specifically illustrated and described, it will be understood that the invention is not limited thereto, as many variations will be apparent to those skilled in the art. The invention is to be given its broadest interpretation within the terms of the following claims.

What is claimed:

1. Apparatus for crushing solid material, comprising a base, a trough having a material inlet end and a pulverant material outlet end, a power drive unit mounted on said base, for delivering a vibratory force to said trough and for supporting said trough, a crusher bar in said trough for crushing material between said bar and said trough, and pulse generator means for energizing said power drive unit, whereby solid material is crushed in said trough by the action of said power drive unit.

2. Apparatus as set forth in claim 1, wherein said power drive unit includes a horizontal pivot near one end, and means for controlling the elevation of the other end so that the angle of the trough with respect to the horizontal may be varied.

3. Apparatus, as set forth in claim 1, wherein said power drive unit comprises an electromagnet core, a plate connected to said trough and separated from said core portion by an air space, rigid means fixed to said core, and spring means fixed at one end to said rigid means and at the other end to said plate, whereby each energizing pulse applied to said coil attracts the plate toward the core and said spring means returns the plate to its initial position establishing said air space at the end of each pulse.

4. Apparatus, as set forth in claim 3, comprising four corner posts rising from said base and terminating under and spaced from said trough, a pair of side walls parallel to the sides of the trough connecting pairs of said posts, a horizontal pivot connecting opposite posts under the trough inlet and passing through bearing openings in said rigid means near one end of said power drive unit, a pair of aligned arcuate slots in said side walls of the support means, and a bolt passing through said slots and other aligned openings in said rigid means near the opposite end of the power drive unit, whereby adjustment of said bolt in said slots serves to vary the inclination of said power drive unit and said trough with respect to the horizontal.

5. Apparatus, as set forth in claim 4, further comprising a plurality of rods forming a connection between said spring means and said plate, said rods being further connected to a second plate substantially parallel to the first plate, and a positioner formed of a triangularly shaped band fastened along one side to the second plate and along another side to the bottom wall of the trough.

6. Apparatus, as set forth in claim 5, wherein said pulse generator means includes means for varying the generated pulse frequency and pulse duration.

7. Apparatus, as set forth in claim 5, wherein a screen for dewatering wet grind ore is positioned at the outlet end of said trough.

8. Apparatus, as set forth in claim 5, wherein a feed hopper is positioned at the inlet end of said trough, said hopper having a vertically adjustable gate to vary the ore feed rate to the trough.

9. Apparatus, as set forth in claim 5, wherein said trough is covered by a dust collector hood, said hood having a central duct in its top for connection to a vacuum source for drawing dust away from the trough.

10. Apparatus, as set forth in claim 5, wherein said crusher bar has wedge shaped feet so as to present a larger space between it and the trough bottom toward the trough inlet end.

11. Apparatus, according to claim 1, wherein said pulse generator means includes a PNP transistor and an NPN transistor connected in series between a DC input terminal and an output terminal connected to said electromagnetic means in such manner as to be triggered by a silicon controlled rectifier.

12. Apparatus, according to claim 11, wherein said pulse generator means further includes a plurality of selectable circuits having capacitors of different values connected in parallel across said input and output terminals.

* * * * *